US009793076B2

(12) United States Patent
Neugart et al.

(10) Patent No.: US 9,793,076 B2
(45) Date of Patent: Oct. 17, 2017

(54) SWITCHING OPERATING ARRANGEMENT

(71) Applicant: Marquardt GmbH, Rietheim-Weilheim (DE)

(72) Inventors: Elmar Neugart, VS-Villingen (DE); Markus Kramer, Spaichingen (DE); Jürgen Kopp, Aldingen (DE)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 14/956,708

(22) Filed: Dec. 2, 2015

(65) Prior Publication Data

US 2016/0163481 A1 Jun. 9, 2016

Related U.S. Application Data

(63) Continuation of application No. PCT/EP2014/001605, filed on Jun. 13, 2014.

(30) Foreign Application Priority Data

Jun. 13, 2013 (DE) ..... 10 2013 009 864

(51) Int. Cl.
*H01H 23/12* (2006.01)
*H01H 3/12* (2006.01)
(Continued)

(52) U.S. Cl.
CPC ..... *H01H 23/12* (2013.01); *H01H 3/122* (2013.01); *H01H 13/14* (2013.01); *H01H 13/52* (2013.01); *H01H 2235/01* (2013.01)

(58) Field of Classification Search
CPC .... H01H 3/122; H01H 13/14; H01H 2235/01; H01H 23/12; H01H 13/52
(Continued)

(56) References Cited

U.S. PATENT DOCUMENTS 3,940,578 A 2/1976 Pointon
5,555,004 A * 9/1996 Ono ..... G06F 3/0338 200/6 A
(Continued)

FOREIGN PATENT DOCUMENTS

DE 2 417 280 A1 10/1974
DE 44 01 644 A1 7/1995
(Continued)

OTHER PUBLICATIONS

International Preliminary Report on Patentability (Application No. PCT/EP2014/001605) dated Dec. 23, 2015.
(Continued)

*Primary Examiner* — Edwin A. Leon
(74) *Attorney, Agent, or Firm* — Burr & Brown, PLLC

(57) ABSTRACT

A switching operator control arrangement for a motor vehicle. A movable operating area interacts with a shifting device in such a way that the operating area can be moved in a substantially linear manner over at least one distance from a neutral position to an operating position. The operating position can be in the form of a switching position in such a way that the operating area has a switching action on a switching element, a sensor or the like in the switching position. The shifting device includes a rocking lever arrangement which can move in parallel.

10 Claims, 3 Drawing Sheets

(51) Int. Cl.
*H01H 13/14* (2006.01)
*H01H 13/52* (2006.01)

(58) Field of Classification Search
USPC ..... 200/339, 5 A, 245, 292, 295, 338
See application file for complete search history.

(56) References Cited

U.S. PATENT DOCUMENTS

| | | | | |
|---|---|---|---|---|
| 7,579,560 | B2 * | 8/2009 | Choi | H01H 13/7065 200/5 A |
| 8,957,333 | B2 * | 2/2015 | Chou | H01H 13/705 200/5 A |
| 2009/0140994 | A1 | 6/2009 | Tanaka et al. | |
| 2010/0259495 | A1 | 10/2010 | Shigetaka et al. | |

FOREIGN PATENT DOCUMENTS

| | | | |
|---|---|---|---|
| DE | 10 2005 034 763 | B3 | 9/2006 |
| EP | 0 966 010 | A2 | 12/1999 |
| EP | 2 648 074 | A1 | 10/2013 |

OTHER PUBLICATIONS

German Search Report (Application No. 10 2013 009 864.5) dated Mar. 20, 2014.
International Search Report and Written Opinion (Application No. PCT/EP2014/001605) dated Sep. 5, 2014.
Chinese Office Action (Application No. 201480033593.X) dated Feb. 24, 2017 (with English translation).

* cited by examiner

SWITCHING OPERATING ARRANGEMENT

CROSS REFERENCE TO RELATED APPLICATIONS

This application is a continuation of International Application No. PCT/EP2014/001605 filed Jun. 13, 2014, which designated the United States, and claims the benefit under 35 USC §119(a)-(d) of German Application No. 10 2013 009 864.5 filed Jun. 13, 2013, the entireties of which are incorporated herein by reference.

FIELD OF THE INVENTION

The invention relates to a switching operator control arrangement comprising a movable operating area.

BACKGROUND OF THE INVENTION

A switching operator control arrangement of this kind can be designed, for example, as a touchpad for controlling various functions. The switching operator control arrangement can be used, in particular, in a motor vehicle.

A switching operator control arrangement of this kind has an operating area, which can be manually moved, for operator control by the user. The operating area interacts with a shifting means in such a way that the operating area can be moved in a substantially linear manner over at least one distance from a starting position or neutral position to an operating position. The operating position may be in the form of a switching position in such a way that the operating area has a switching action on a switching element, a sensor or the like in the switching position. In this case, a switching signal is then generated, it being possible for the switching signal to be used, in turn, in order to trigger a correspondingly associated function. It has been found that the operating area can tilt, in particular in the case of an operating area of large dimensions, when it is operated by the user.

SUMMARY OF THE INVENTION

The invention is based on the object of further developing the switching operator control arrangement in such a way that tilting of the operating area is largely avoided when it is operated by the user.

In the case of the switching operator control arrangement according to the invention, the shifting means comprises a rocking lever arrangement which, in particular, can move in parallel. This advantageously results in parallel guidance of the operating area as it moves, so that tilting of the operating area is largely avoided.

The switching element, the sensor or the like can generate a signal on account of the switching action of the operating area in the switching position. This signal can then in turn serve to switch and/or trigger an associated function in the manner of a switching signal. For example, in the case of a touchpad, which is designed according to the present invention, in the form of a switching operator control arrangement, a desired function in the motor vehicle can then be selected by the user by the user moving a finger on and/or over the operating area. The operating area is then moved by pressing the operating area by means of the finger in order to generate the switching signal, as a result of which the associated function in the motor vehicle is in turn switched and/or triggered.

As is customary, a housing can be provided for the switching operator control arrangement. The operating area is preferably arranged on a surface of the housing which is manually accessible to the user after the switching operator control arrangement has been installed in the motor vehicle. Furthermore, for the sake of ease of operator control, the operating area can be moved into the interior of the housing. The rocking lever arrangement can expediently be located in the interior of the housing, as a result of which said rocking lever arrangement is protected against external influences. In order to further improve the guidance for the operating area, a further rocking lever arrangement can be arranged approximately parallel to the rocking lever arrangement. In order to once again further improve the guidance, in each case one rocking lever arrangement can be located on two sides of the operating area which are situated opposite one another.

In a first refinement which operates in a particularly precise manner, the rocking lever arrangement can have rotationally mounted lever pairs. In a second refinement which is particularly cost-effective, the rocking lever arrangement can have elastic elements which are braced in parallel and which may be, in particular, leaf springs.

In a compact refinement, the rocking lever arrangement can have a floating bearing on one side and a fixed bearing on the other, opposite side. In a simple refinement, the floating bearing can comprise a moving plate. The moving plate can preferably be guided in a rotational and/or linear manner in a bearing on the housing.

An attachment which projects in a substantially perpendicular manner can be arranged on the operating area in a compact manner. The attachment is preferably arranged on that side of the operating area which faces the interior of the housing. The attachment can expediently be located approximately centrally on the operating area. Furthermore, the attachment can be located in the housing.

In the first refinement, it may be appropriate for the rocking lever, at one end, to be rotationally mounted on the attachment by means of a rotary bearing or rotary joint and, at its other end, to be rotationally mounted on a bearing, which is fixed to the housing, by means of a further rotary bearing or rotary joint. The other rocking lever can, at one end, be rotationally mounted on the attachment by means of a rotary bearing or rotary joint and can, at its other end, be rotationally mounted on a floating bearing by means of a further rotary bearing or rotary joint. As a result, the operating area can be moved into the housing in particular substantially in the direction of the attachment. The switching operator control arrangement according to this first refinement is compact and constructed in a simple manner.

In the second refinement, it may be appropriate for one leaf spring, at one end, to be fastened to the attachment and, at its other end, to be fastened in a manner fixed to the housing. The other leaf spring can, at one end, be fastened to the attachment and can, at its other end, be fastened to a floating bearing. In order to fasten or fix the leaf spring, it may be appropriate for the ends of said leaf spring to be correspondingly clamped. As a result, the operating area can be moved into the housing in particular substantially in the direction of the attachment. The switching operator control arrangement according to this second refinement is compact and constructed in a cost-effective manner.

Finally, an elastic element for repositioning the operating area in the starting position and/or for generating haptics for the movement of the operating area can interact with the operating area in a simple manner. The elastic element can expediently interact with the attachment. In a cost-effective manner, the elastic element can comprise a compression spring.

The following should be noted in respect of a particularly preferred refinement of the switching operator control arrangement according to the invention.

The switching operator control arrangement is designed as an input device comprising a laterally moving, large operator control surface. By way of example, the operator control area can have dimensions of approximately 110 mm×70 mm and be operated in a linear manner in the z direction. Tilting and/or non-linear movements at different points should be prevented as far as possible. The movement in the z direction is less than 1 mm. The variations in the surface design and/or surface styling should provide degrees of freedom which are as large as possible. The unit should be designed so as to be as compact as possible and/or so as to optimize installation space as far as possible. As low a number of moving parts as possible is also desirable. Vibrations in the vehicle should not lead to interfering noise being created.

A rocking lever arrangement which can move in parallel is proposed as a solution for meeting these requirements on the switching operator control arrangement. This rocking lever arrangement can be realized by means of rotationally mounted lever pairs and/or in the form of leaf springs which are braced in parallel. These are mounted as parallel levers in principle. In respect of the operating principle, this means that one side is fixed as a floating bearing and the other side, on the other, opposite side, is fixed as a fixed bearing. In order to dispense with the floating bearing, the floating bearing can be realized in the plastic deformation of the spring elements and the connection thereof in the embodiment as a leaf spring pack. A further possible way of arranging the floating bearing is the use of a moving plate with rotational and/or linear guidance of the bearing.

Therefore, an operator control area which is guided in parallel and, in particular, has different haptics elements is provided.

The advantages achieved with the present invention include the following in particular:

(a) low number of components for the switching operator control arrangement;

(b) high-quality parallel guidance of the operating area with maximum dimensional accuracy during parallel shifting in the movement direction;

(c) high level of rigidity of the arrangement in the x and y directions;

(d) very low level of friction for the movement of the operating area;

(e) freedom from play for the operating area;

(f) high level of surface rigidity of the arrangement;

(g) compact construction for the switching operator control arrangement;

(h) high level of flexibility in terms of the haptics design for the switching operator control arrangement by choosing the spring elements or the elastic element and/or the design thereof; and (i) the ability to be easily integrated into the manufacturing process for the switching operator control arrangement and ability to produce said switching operator control arrangement in a simple manner and/or ease of assembly of said switching operator control arrangement.

BRIEF DESCRIPTION OF THE DRAWINGS

Exemplary embodiments of the invention with different developments and refinements are illustrated in the drawings and will be described in greater detail below.

DETAILED DESCRIPTION OF THE INVENTION

Figure 1:
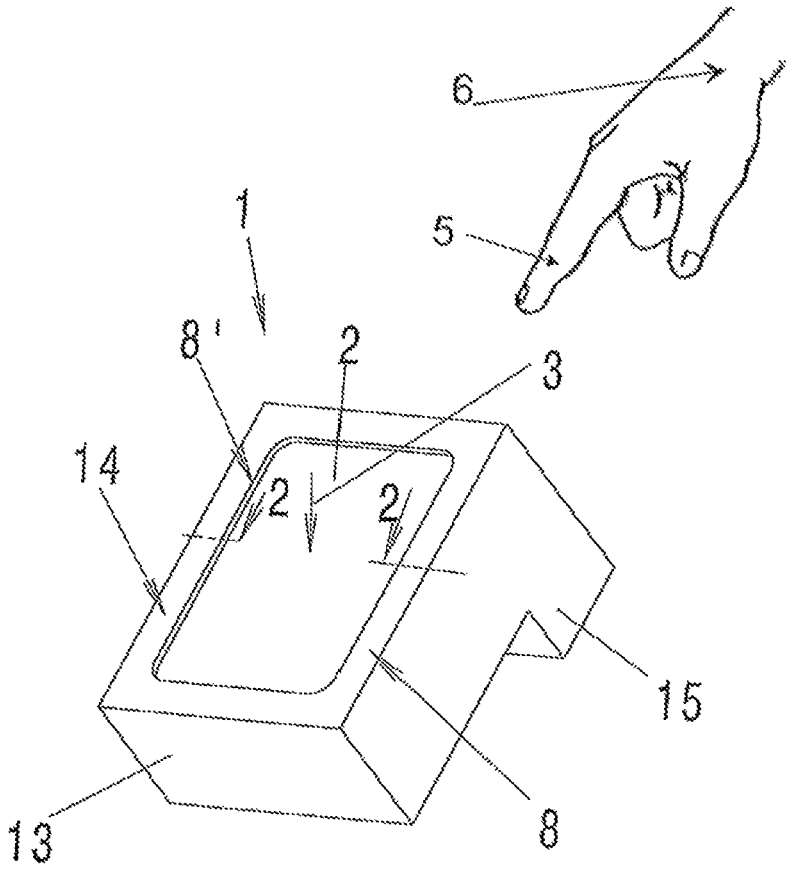
FIG. 1 shows a perspective view of a switching operator control arrangement.

FIG. 1 shows a switching operator control arrangement 1 in the form of a touchpad which is used, in particular, for a motor vehicle. The switching operator control arrangement 1 has a housing 13 which is composed of plastic and which has, on its manually accessible surface 14, an operating area 2 which extends in the x and y directions. The user can operate the switching operator control arrangement 1 in the intended manner by manually acting on the operating area 2 by means of an element 5. The element 5 may be a finger 5 on a human hand 6, so that operator control in the intended manner is possible by means of corresponding movement of the finger 5. By way of example, the switching operator control arrangement 1 can be arranged in the center console of the motor vehicle and be provided for operating a navigation system, a screen or the like in the motor vehicle. The switching operator control arrangement 1 can be connected, for example, to a bus system in the motor vehicle by means of a plug connection 15.

The switching operator control arrangement 1 is provided with a sensor, not shown any further, which interacts with the operating area 2. The sensor which operates, for example, in a capacitive manner and/or with infrared radiation generates a signal as the element 5, for example the finger 5 of the hand 6 of the user in this case, approaches the operating area 2 and/or when the element 5 makes contact with the operating area 2 and/or when the element 5 exerts pressure onto the operating area 2. The signal then serves to switch and/or trigger and/or select a function in the motor vehicle in the manner of a switching signal.

The operating area 2 of the switching operator control arrangement 1 is further designed such that it can move in direction 3 (z direction), so that the operating area 2 can be moved in the direction 3, and therefore in a direction toward the interior of the housing 13, by means of the finger 5 in a manual manner. As further shown in FIG. 2, the operating area 2 interacts with a shifting means 4 for this purpose in such a way that the operating area 2 can be moved in a substantially linear manner over at least one distance from a starting or neutral position to an operating position. The operating position is in the form of a switching position such that the operating area 2 has a switching action on an electrical switching element 7 in the switching position. In this case, the switching element 7 generates a switching signal which can serve, for example, as an "enter" command and therefore to switch and/or trigger the associated function in the motor vehicle. A sensor, such as a Hall sensor, an inductive sensor, a light barrier or the like can also be used instead of an electrical switching element 7.

Figure 2:
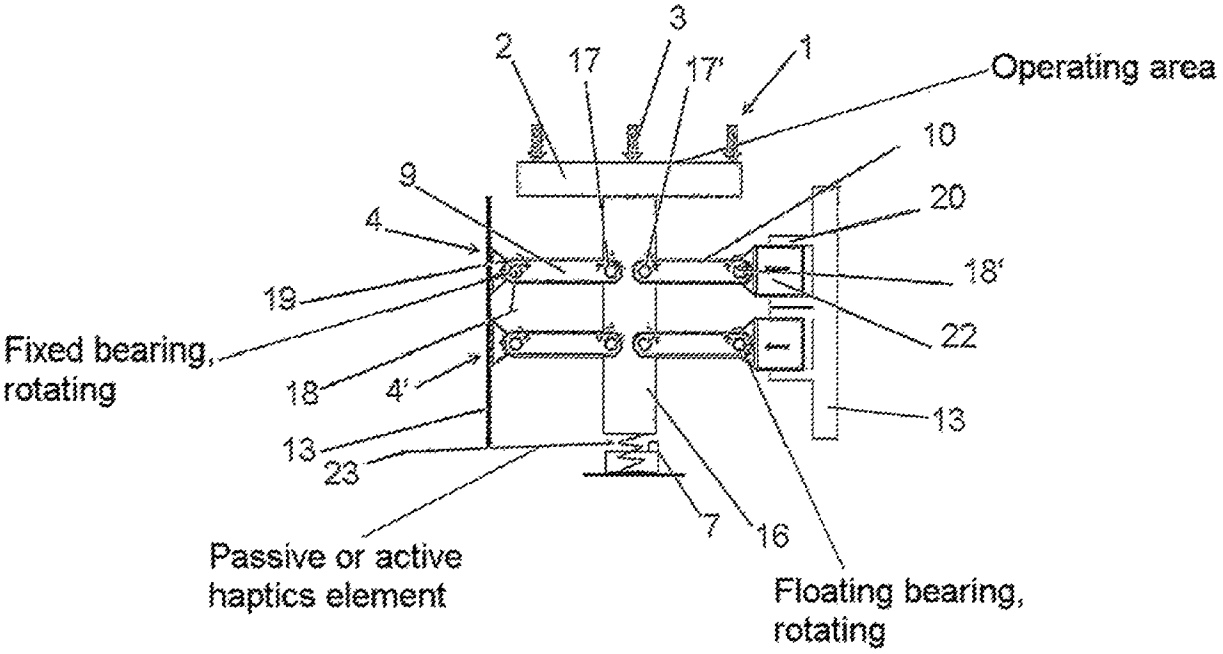
FIG. 2 shows a schematic section along line 2-2 in FIG. 1 in the manner of a basic diagram showing the functioning of the switching operator control arrangement according to a first embodiment.

As is further shown with reference to FIG. 2, the shifting means 4 comprises a rocking lever arrangement. In the present case, the rocking lever arrangement 4 is designed such that it can move in parallel and is located in the interior of the housing 13. For the purpose of improving the guidance in direction 3, a further rocking lever arrangement 4' is arranged approximately parallel to the rocking lever arrangement 4. If desired, in each case one rocking lever arrangement 4, 4' can be located on two sides 8, 8', which are situated opposite one another according to FIG. 1, of the operating area 2 in order to further improve the parallel guidance.

As is clear with reference to FIG. 2, an attachment 16 which projects in a substantially perpendicular manner is arranged on the operating area 2. The attachment 16 is arranged on that side of the operating area 2 which faces the interior of the housing 13 and also approximately centrally on the operating area 2, and is located in the housing 13. The rocking lever arrangement 4, 4' is connected to said attachment 16 in order to interact with the operating area 2.

In a first embodiment according to FIG. 2, the rocking lever arrangement 4, 4' has lever pairs 9, 10 which are mounted in a rotational manner. One rocking lever 9 is, at one end, mounted in a rotational or articulated manner on the attachment 16 by means of a rotary bearing 17 and is, at its other end, mounted in a rotational or articulated manner on a bearing 19, which is fixed to the housing, by means of a further rotary bearing 18. The other rocking lever 10 is, at one end, mounted in a rotational or articulated manner on the attachment 16 by means of a rotary bearing 17' and is, at its other end, mounted in a rotational or articulated manner on a floating bearing 20 by means of a further rotary bearing 18'. As a result, the operating area 2 can be moved into the housing 13 substantially in the direction of the attachment 16, that is to say in direction 3.

Figure 3:
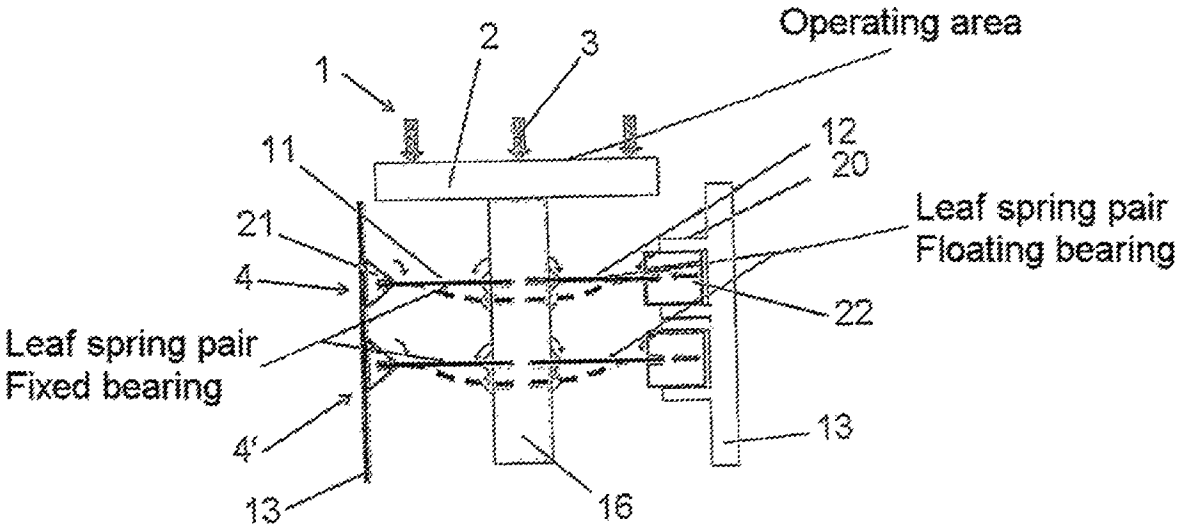
FIG. 3 shows a schematic section as in FIG. 2 according to a second embodiment.

In a second embodiment according to FIG. 3, the rocking lever arrangement 4, 4' has elastic elements 11, 12 which are braced in parallel. In the present case, the elastic elements 11, 12 are leaf springs. One leaf spring 11 is, at one end, fastened or clamped to the attachment 16 and is, at its other end, fastened or clamped in a fixing means 21 such that it is fixed to the housing. The other leaf spring 12 is, at one end, fastened or clamped to the attachment 16 and is, at its other end, fastened or clamped to a floating bearing 20. As a result, the operating area 2 can be moved into the housing 13 substantially in the direction of the attachment 16, that is to say in direction 3, as is indicated in FIG. 3 with reference to the leaf springs 11, 12 which are illustrated using dashed lines.

The two embodiments according to FIGS. 2 and 3 therefore share the common feature that the rocking lever arrangement 4, 4' has a floating bearing 20 on one side and has a fixed bearing 19, 21 on the other, opposite side. The floating bearing 20 can comprise a moving plate 22. According to FIGS. 2 and 3, the moving plate 22 is guided in a linear manner in a bearing on the housing 13. If desired, the moving plate of the floating bearing can also be guided in a rotational manner in a bearing on the housing 13, but this is not shown any further.

Finally, an elastic element 23, which is shown in FIG. 2, for repositioning the operating area 2 to the starting position and/or for generating haptics for the movement of the operating area 2 in the operating position can interact with the operating area 2. The elastic element 23 is a compression spring which, in this case, acts on the attachment 16.

The present invention is not restricted to the exemplary embodiments described and illustrated. Instead, it also includes all developments by a person skilled in the art within the scope of the invention defined by the patent claims. Therefore, the switching operator control arrangement 1 according to the invention can not only be used as a touchpad for motor vehicles but also for other switching elements with operator control surfaces which have a large area and also with linear operation and possibly with short strokes. Furthermore, the switching operator control arrangement 1 can also be used in domestic appliances, audio appliances, video appliances, telecommunications appliances or the like.

LIST OF REFERENCE SYMBOLS

1: Switching operator control arrangement
2: Operating area
3: Directional arrow
4: Shifting means/rocking lever arrangement
4': (Further) rocking lever arrangement
5: Element/finger
6: Hand (of user)
7: (Electrical) switching element
8, 8': Side (of the operating area)
9, 10: Lever pair/rocking lever
11, 12: Elastic element/leaf spring
13: Housing (of switching operator control arrangement)
14: Surface (of housing)
15: Plug connection (on the housing)
16: Attachment
17, 17': Rotary bearing
18, 18': (Further) rotary bearing
19: Bearing (which is fixed to the housing)/fixed bearing
20: Floating bearing
21: Fixing means/fixed bearing
22: (Moving) plate (of floating bearing)
23: Elastic element

The invention claimed is:

1. A switching operator control arrangement for a motor vehicle, comprising a movable operating area, wherein the operating area interacts with a shifting means in such a way that the operating area is movable in a substantially linear manner over at least one distance from a starting position to an operating position, wherein the operating position is configured as a switching position in such a way that the operating area has a switching action on at least one of a switching element, and a sensor, wherein the shifting means comprises a rocking lever arrangement, the rocking lever arrangement including at least first rocking levers arranged substantially in parallel with respect to one another, and second rocking levers arranged to move substantially in parallel with respect to one another, and wherein the rocking lever arrangement has a movable bearing on one side and a fixed bearing on an opposite side.

2. The switching operator control arrangement as claimed in claim 1, wherein the at least one of the switching element, and the sensor generates a signal on account of the switching action of the operating area in the switching position, and wherein the signal preferably serves to switch and/or trigger a function in the manner of a switching signal.

3. The switching operator control arrangement as claimed in claim 1, wherein a housing is provided, in that the operating area is arranged on a surface of the housing and can be moved into the interior of the housing, wherein the rocking lever arrangement is further located in the interior of the housing, wherein a further rocking lever arrangement is yet further arranged approximately parallel to the rocking lever arrangement, and wherein in each case one rocking lever arrangement is once again further located on two sides of the operating area which are situated opposite one another.

4. The switching operator control arrangement as claimed in claim 3, wherein the rocking lever arrangement has rotationally mounted lever pairs, and/or wherein the rocking lever arrangement has elastic elements, which are braced in parallel.

5. The switching operator control arrangement as claimed in claim 3, wherein the rocking lever arrangement has the movable bearing on the one side and the fixed bearing on the other, opposite side.

6. The switching operator control arrangement as claimed in claim 5, wherein the floating bearing comprises a moving plate, and wherein the moving plate is guided in a rotational and/or linear manner in a bearing on the housing.

7. The switching operator control arrangement as claimed in claim 1, wherein an attachment which projects in a substantially perpendicular manner is arranged on the operating area, on that side of the operating area which faces the interior of the housing, wherein the attachment is located approximately centrally on the operating area, and wherein the attachment is further located in the housing.

8. The switching operator control arrangement as claimed in claim 7, wherein one rocking lever is, at one end, rotationally mounted on the attachment by means of a rotary bearing and is, at its other end, rotationally mounted on a bearing, which is fixed to the housing, by means of a further rotary bearing, and wherein, the other rocking lever is, at one end, rotationally mounted on the attachment by means of a rotary bearing and is, at its other end, rotationally mounted on a floating bearing by means of a further rotary bearing, in such a way that the operating area can be moved into the housing substantially in the direction of the attachment.

9. The switching operator control arrangement as claimed in claim 7, wherein one leaf spring is, at one end, fastened to the attachment and is, at its other end, fastened to a fixing means which is fixed to the housing, and wherein the other leaf spring is, at one end, fastened to the attachment and is, at its other end, preferably fastened to a floating bearing, in such a way that the operating area can be moved into the housing substantially in the direction of the attachment.

10. The switching operator control arrangement as claimed in claim 1, wherein an elastic element for repositioning the operating area and/or for generating haptics for the movement of the operating area interacts with the operating area, with the attachment, and wherein the elastic element comprises a compression spring.

* * * * *